US005085111A

United States Patent [19]

Birkhofer

[11] Patent Number: 5,085,111

[45] Date of Patent: Feb. 4, 1992

[54] APPARATUS FOR STACKING FLAT ARTICLES

[75] Inventor: Herbert Birkhofer, Brunswick, Fed. Rep. of Germany

[73] Assignee: Windmoller & Holscher, Lengerich, Fed. Rep. of Germany

[21] Appl. No.: 436,043

[22] Filed: Nov. 14, 1989

[30] Foreign Application Priority Data

Nov. 14, 1988 [DE] Fed. Rep. of Germany ..... 3838563

[51] Int. Cl.[5] ..... B31B 1/64

[52] U.S. Cl. ..... 83/91; 493/204; 83/171; 83/95

[58] Field of Search ..... 83/91, 94, 95, 171, 83/566, 856; 493/204

[56] References Cited

U.S. PATENT DOCUMENTS 4,758,214 7/1988 deBin ..... 493/204
4,796,499 1/1989 Achelpohl ..... 493/204
4,878,888 11/1989 Ullmann ..... 493/204

FOREIGN PATENT DOCUMENTS 3415992 11/1985 Fed. Rep. of Germany .
3505858 6/1986 Fed. Rep. of Germany .
3611369 1/1987 Fed. Rep. of Germany .
3637491 5/1988 Fed. Rep. of Germany .

*Primary Examiner*—W. Donald Bray
*Attorney, Agent, or Firm*—Fleit, Jacobson, Cohn, Price, Holman & Stern

[57] ABSTRACT

An apparatus is provided for stacking flat articles, such as double bags, which have been severed by hot-wire welding from a continuous tubular or semitubular plastic film and have opening-defining edges adjacent to their center lines. The bags are delivered by a transfer apparatus, called a wicketer. The wicketer has feeding arms, which are secured to a shaft and rotate about a horizontal axis and which are arranged in pairs in a starlike array. The bags are needled adjacent to their longitudinal center line on a holding plate, which is provided in a stacking station and carries upstanding stacking pins or needles, so that stacks are formed. Two radial holding plates are rotatably mounted on the shaft or axle and are connected to separate respective drives for pivotally moving the holding plates to a stacking position for receiving the articles. One of several types of devices is provided for removing the stacks from the holding plates, which have consecutively been rotated to the stacking position, and for removing the stacks.

9 Claims, 8 Drawing Sheets

APPARATUS FOR STACKING FLAT ARTICLES

BACKGROUND OF THE INVENTION

1. Field of the Invention

This invention relates to an apparatus for stacking flat articles, such as double bags, which have been severed by hot-wire welding from a continuous tubular or semi-tubular plastic film and have opening-defining edges adjacent to their center lines. The articles are delivered by a transfer apparatus, called a wicketer, which comprises feeding arms. The feeding arm secured to a shaft and rotating about a horizontal axis are arranged in pairs in a starlike array, and the bags are needled, adjacent to their longitudinal center line, on a holding plate, which is provided in a stacking station and carries upstanding stacking pins or needles, so that stacks are formed.

2. Description of the Prior Art

Such apparatuses are known, e.g., from German Patent Specification 36 11 237 and the corresponding U.S. Pat. No. 4,796,499 and from German Utility Model Specification 80 00 912. However, these known apparatuses have the problem that each stack must be so quickly removed from the range of the arms feeding the articles that it is difficult to operate the apparatus without an interruption.

Published German Application 36 11 369 discloses a stacking wicketer in which temporary stacks of flat articles are formed on a magazine plate, which is slidable to and from a receiving position so that the apparatus can be operated without a need for interrupting the feeding. This known apparatus has a complicated structure and requires a movement of large masses within a very short time.

SUMMARY OF THE INVENTION

For this reason, it is an object of the invention to provide an apparatus which is of the kind described above and in which the flat articles are continuously fed and stacks are formed and removed without a need for a sudden acceleration and braking of parts of the stacking apparatus.

In an apparatus of the kind described first hereinbefore, this object is accomplished in accordance with the invention in that two redial holding plates are rotatably mounted on the shaft or axle and are connected to separate respective drives for pivotally moving the holding plates to a stacking position for receiving the articles. Means are provided for removing the stacks from the holding plates, which have consecutively been rotated to the stacking position, and for removing the stacks.

In the apparatus in accordance with the invention, each stack is formed on a holding plate, which is rotatable about the axis of the wicketer in identical radial planes and receives the flat articles as they are delivered by the feeding arms. When a stack consisting of a predetermined number of articles has been formed on a holding plate, that holding plate, which is in a stand-by position below the holding plate on which the last preceding stack has been collected, is rotated to its stacking position above the last preceding stack at the same angular velocity as the feeding arms. During the formation of the new stack, the last preceding stack can be removed from that holding plate which is now disposed below the holding plate for receiving the articles being fed, and the stack can then be carried off. When the last preceding stack has been removed from the holding plate, the latter can be pivotally moved to a stand-by position and will then be rotated to its stacking position at the same angular velocity as the feeding arms when a stack consisting of the desired number of articles has been formed on the next succeeding stacking plate. As soon as a stack has been removed from a holding plate and the latter has then been pivotally moved to its stand-by position, the next following holding plate can be pivotally moved during the stacking operation to a position in which the complete stack can then be removed from that holding plate. The stacking on the next succeeding holding plate can begin at a time at which said holding plate has not yet been rotated to a position in which the complete stacks are removed from said holding plate. This is due to the fact that the holding plates are rotatably mounted on the axis of the wicketer so that a holding plate will always be in a proper position relative to the articles to be stacked.

In accordance with a further feature of the invention, a carriage-like transfer conveyor is provided for receiving the stacks from the holding plate and for carrying off the stacks. The transfer conveyor is provided with grippers, and transfers the stacks to a stack conveyor, which consists of intermittently driven tensile elements, which are trained around reversing wheels or reversing rollers.

The tensile elements of the stack conveyor are desirably provided with upright needles or stacking pins.

According to a further preferred feature of the invention, the transfer conveyor extends in track channels or the like provided on a frame or table which is adapted to be lifted and lowered. In such an arrangement, each stack which is to be transferred to the stack conveyor can initially be fed above the plane of the tips of the needles or pins and can subsequently be lowered for being needled onto the stack conveyor.

In accordance with a further feature of the invention, the transfer conveyor comprises retaining jaws, which are mounted on chains or the like, which are driven to reciprocate. Grippers for cooperation with the retaining jaws are movably mounted on said chains or the like.

It is suitable to provide grippers, arranged in pairs on opposite sides of the stack. The spacing of said grippers of each pair is preferably adjustable to adapt to the size of the stack. In that case, one retaining jaw may be fixed to the chain and the associated retaining jaw may be slidable relative to the first-mentioned retaining jaw on guide rods or slide pieces provided on the chain.

The transfer conveyor and the stack conveyor suitably overlap each other to permit a simple transfer.

Independent protection is also claimed for another embodiment of the invention in which a stationary cutter blade for severing the stacks is provided above the transfer conveyor and/or the stack conveyor and the stacks are adapted to be urged against the cutter blade by an abutment, which is adapted to be lifted and lowered. In order to ensure a good retention of the stacks which are to be separated, pressure-applying bars, which are adapted to be lifted and lowered and cooperate with the abutment, may be provided on both sides of the cutter blade.

The stacking apparatus is not only suitable for a stacking of, such as double bags, which are to be fixed adjacent to their center line, but can also be used to stack single bags. For this reason, a further feature of the invention resides in that for a stacking of single bags, which are to be needled adjacent to their opening-defining edges, two forked holding plates are movably mounted on the shaft or axle of the wicketer and are pivotally movable in the same radial planes. Such forked holding plates differ from the holding plates used for stacking articles which are to be fixed adjacent to their center line essentially in that the forked holding plates provide wider contact surfaces.

DETAILED DESCRIPTION OF THE PREFERRED EMBODIMENTS

Figure 1:
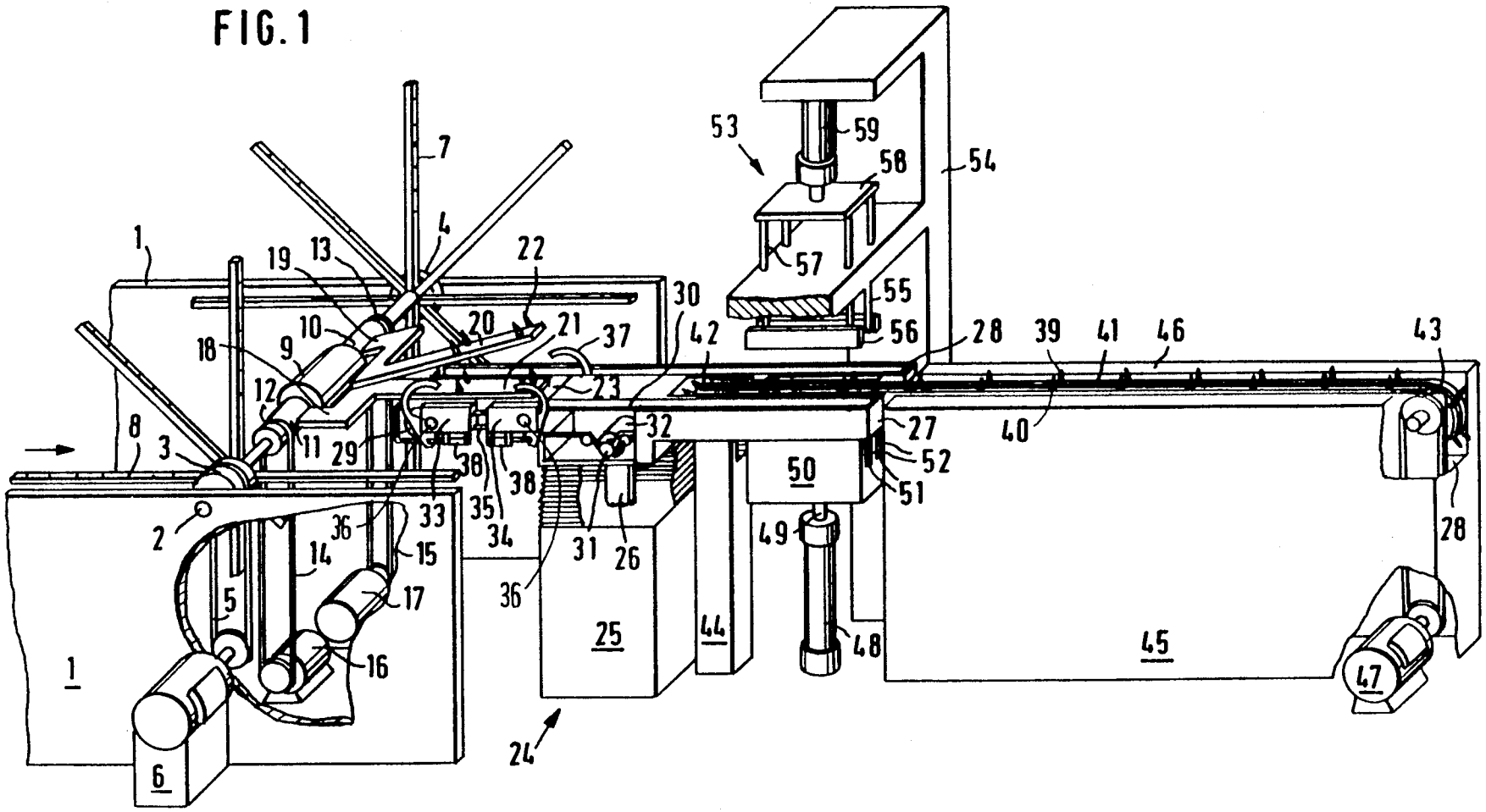
FIG. 1 is a perspective side view showing the means for feeding the bags.

Illustrative embodiments of the invention will now be explained more in detail with reference to the drawings.

A shaft 2 is rotatably mounted in two spaced apart side frames 1. Two hubs 3 and 4 are mounted on the shaft 2 between the side frames 1. The hub 3 constitutes a belt pulley. The shaft 2 can be rotated by means of a motor 6 via a belt 5. Radially outwardly extending spokes 7 are mounted in known manner on the hubs 3 and 4. The spokes 7 are hollow and formed with suction bores 8. Approximately at the center of the length of the shaft 2, a spacer 9 is fixed to the shaft 2. On both sides of the spacer 9, sleeves 10 and 11 are freely rotatably mounted on the shaft 2. The sleeves 11 are formed on their outside peripheral surfaces with peripheral annular recesses 12 and 13, in which respective vee belts 14 and 15 extend. Each vee belt is driven by a separate motor 16 or 17 so that the sleeves 10 and 11 can be driven independently of each other.

Angled arms 18 and 19 are fixedly welded to the sleeves 10 and 11 and have free end portions 20 and 21 which lie one over the other. During their rotational movement, the free end portions 20 and 21 move through a U-shaped recess 23, which is formed in a lifting table 24. The lifting table 24 essentially consists of a column 25 and a piston-cylinder unit which is mounted in that column and comprises a piston rod 25, which is connected to a detachable member 27. That member 27 consists of a hollow casting and is formed with two lateral track channels 28. Two reversing chain sprockets are movably mounted in each of the track channels 28. Only one of the chain sprockets, designated 29, is shown. An endless chain 30 is trained around both chain sprockets and is in mesh with a drive pinion 31, which is driven by a motor 32. Two holders 33 and 34 are fixedly connected to the chain 30 and their spacing is adjustable by screws 35. Grippers 37 are mounted by pivots 36 on the holders 33 and 34, which are movable by piston-cylinder units 38.

On that side of the table column 25 which is opposite to the free end portions 20 and 21, a conveyor belt 41 is provided, to which two rows of needles 39 and 40 are secured and which comprises forward and rear reversing pulleys 42 and 43. The front reversing pulley 42 is disposed between the two track channels 28 and is held by a column 44. The rear reversing pulley 43 is movably mounted in two spaced apart parallel frame side walls 45 and 46 and is adapted to be driven by a motor 47. It is apparent from FIG. 1 that a piston-cylinder unit 48 is provided beside the column 44 and has a piston rod 49, which carries an abutment 50. The abutment 50 is formed with two recesses 51, through which the belts 52 of the belt conveyor 41 extend. The recesses 41 are deep enough that the piston rod 49 can lift the abutment 50 a certain extent. A bag-severing device 53 is provided above the abutment 50 and above the belt conveyor 41 and is carried by a portal 54, which is connected to the side walls 45 and 46. The bag-severing device essentially comprises a stationary cutter blade 55 and pressure-applying bars 56, which extend on both sides of the cutter blade and are connected by guide rods to a plate 58, which is adapted to be lifted and lowered by a piston-cylinder unit 59.

Figure 2:
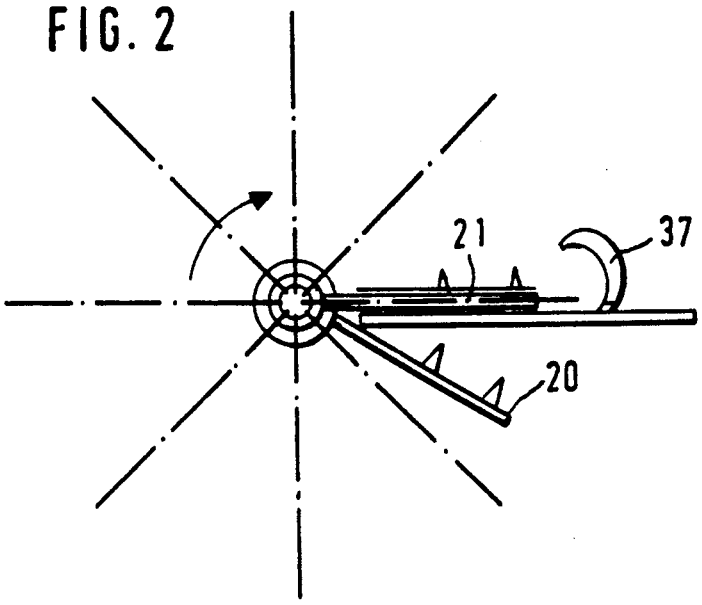
FIGS. 2 to 5 illustrate diagrammatically the intermediate stacking sequence.
Figure 3:
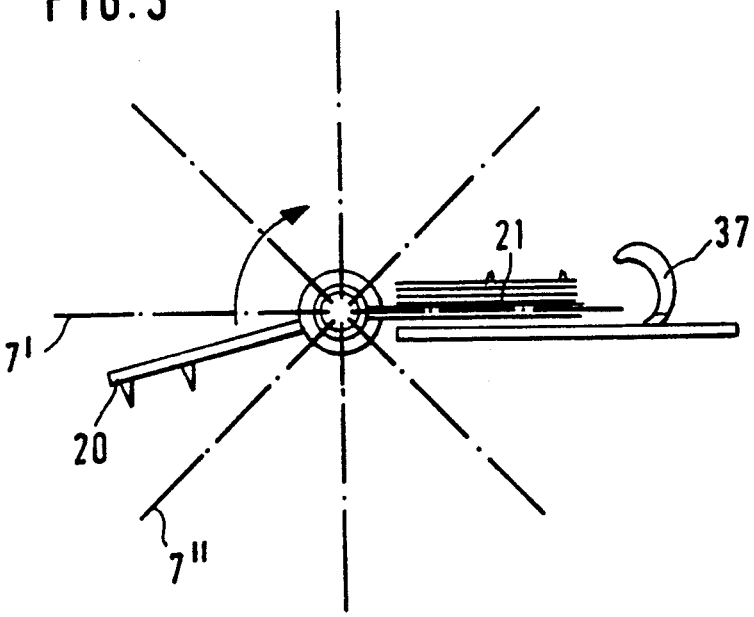
Figure 4:
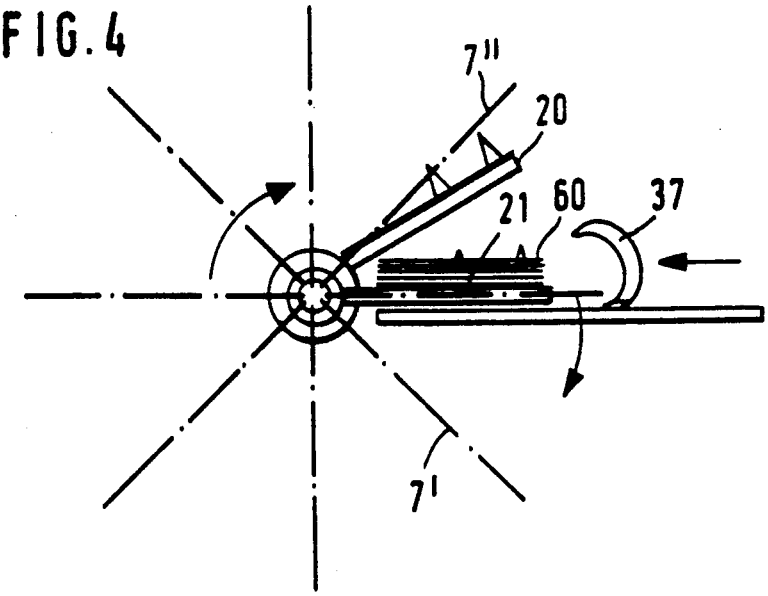
Figure 5:
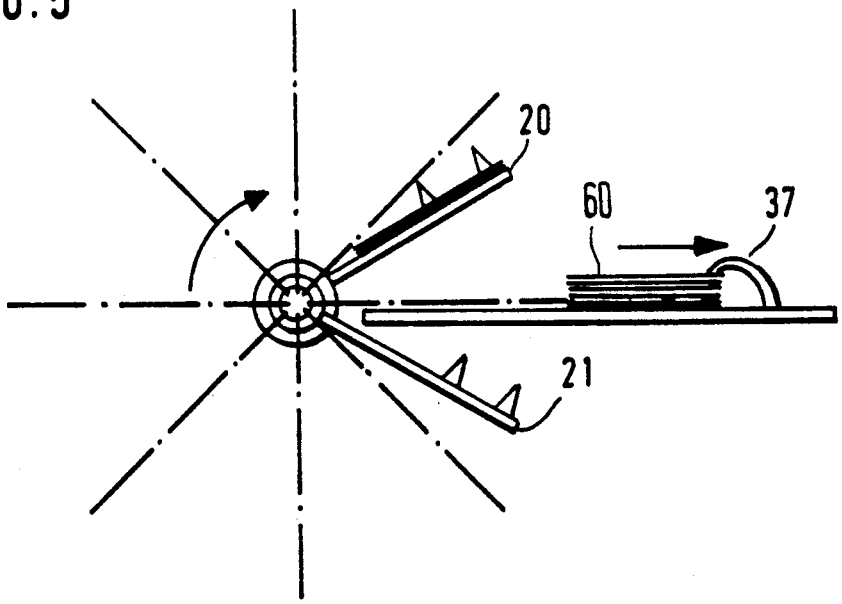

The mode of operation of the free end portions of the angled arms 18 and 19 will now be explained with reference to FIGS. 2 to 5 as well as to FIG. 1. The free end portion 21 is shown FIG. 1 to extend in the U-shaped recess 23 between the track channels 28. The several bags which are fed by the spokes 7 are then needled to the free end portion 21 whereas the free end portion 20 is in a neutral position below the free end portion 21, as FIG. 2 shows. As soon as a sufficient number of bags have been needled on the free end portion 21, the motor 17 is started so that the free end portion 20 is pivotally moved through the position shown in FIG. 3 to the position shown in FIG. 4. The position of portions 20 and 21 shown in FIG. 4 is also shown in FIG. 1. The free end portion 20 may move at any desired speed from the position shown in FIG. 2 to the position shown in FIG. 3. However, from the position shown in FIG. 3, the angular velocity at which the free end portion 20 moves must be equal to the angular velocity of the spokes 7, because if the free end portion 20 was moved at a higher velocity, it might strike from the spokes 7' a bag which has previously been applied to the spokes 7'. The angular movement of the free end portion 20 is stopped in the position shown in FIG. 4 so that the bag which has been applied to the spokes 7'' and the following bags are now deposited on the free end portion 20 rather than on the free end portion 21. The stack 60 which has temporarily been deposited on the free end portion 21 is then gripped by the grippers 37 and can then be removed as soon as the empty free end portion 21 has been moved to the position shown in FIG. 5 by the motor 16, which has been started. When the stack has been removed from the free end portion 21, the free end portion 20 shown in FIG. 5 can be moved to the position in which the free end portion 21 is shown in FIG. 2.

Figure 7:
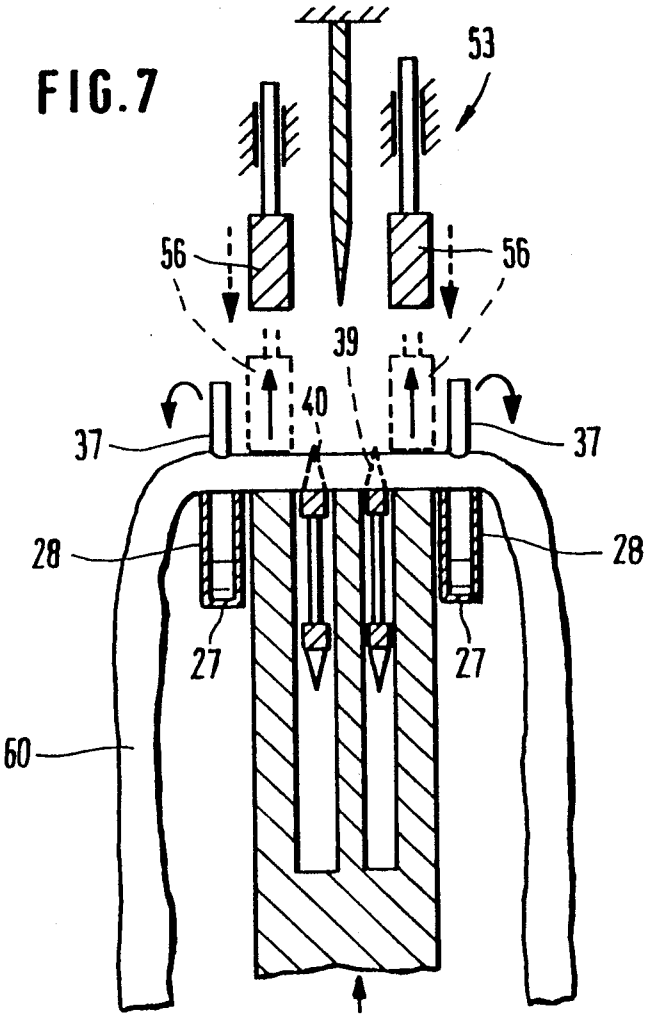
FIGS. 6 to 9 show consecutive positions assumed as the stacks are separated.
Figure 6:
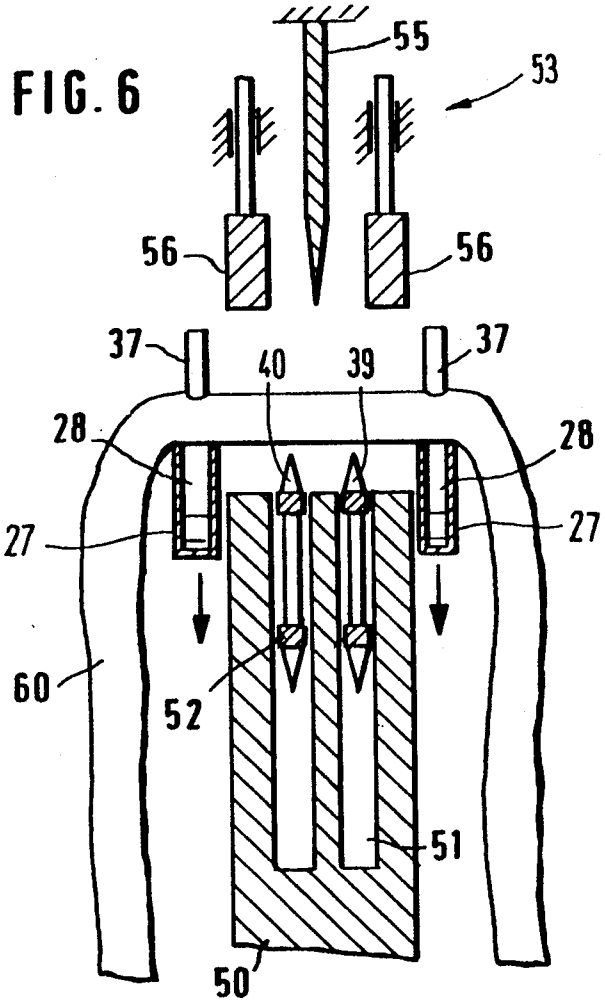
Figure 9:
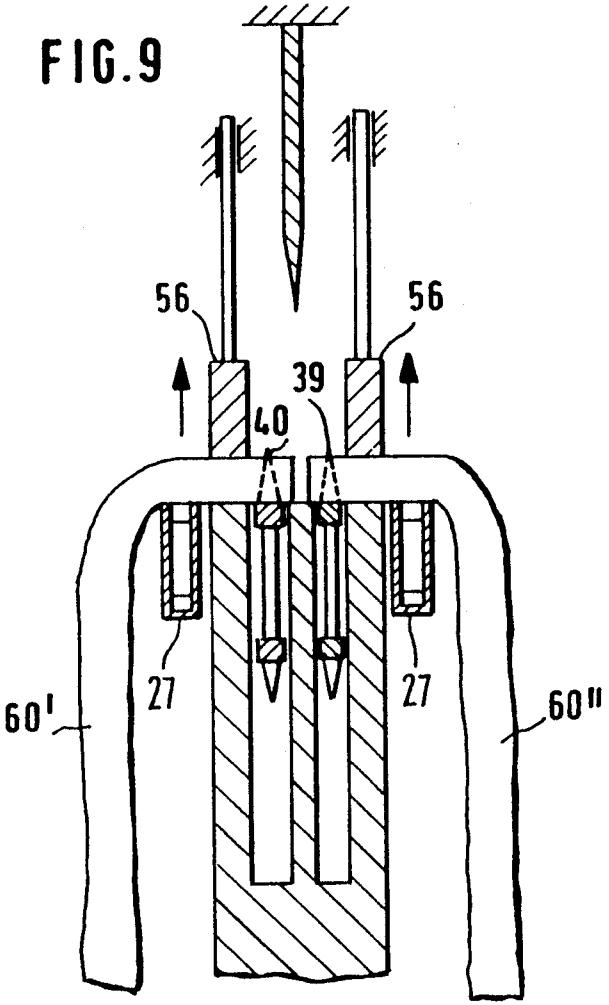
Figure 8:
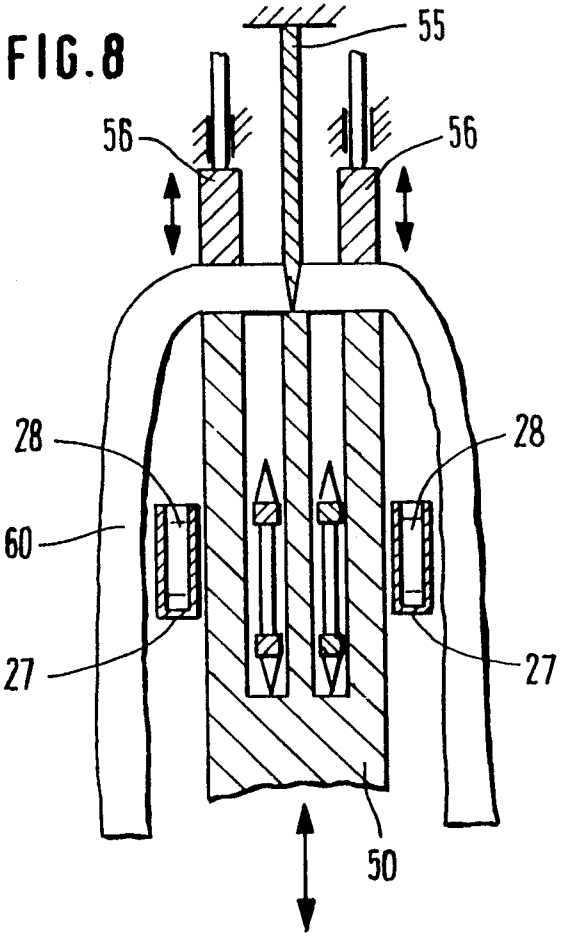

During the conveyance of the stack 60 to a position under the bag-severing device 53, the members 27 of the lifting table 24 are sufficiently lifted so that the stack 60, which has been clamped by the grippers 37 against the holders 33 and 34, is disposed above the rows of needles 39 and 40. That position is shown in FIG. 6. When a stack 60 is then disposed under the stack-severing device 53, the pressure-applying bars 56 will be forced against the stack 60 from above so that the stack 60 is forced down onto the rows of needles 39 and 40. Each part 27 is lowered at the same time. That position is shown in FIG. 7, with the pressure-applying bars 56 represented by dotted lines. The grippers 37 are then swung down to extend into the track channels 28, from which the grippers 37 now no longer protrude. The motor 32 (FIG. 1) is then reversed so that the grippers 37 are returned to the position shown in FIG. 1, although the grippers initially remain swung down and will not assume the end position shown in FIG. 1 until a stack has been formed and is to be clamped. During the movement of the grippers to their initial position the lifting cylinder 48 is operated to force the stack 60 against the stationary cutter blade 55 so that the stack 60 is severed by the cutter blade. As the abutment 50 is raised, the pressure-applying bars 56 are returned. The resulting position is shown in FIG. 8. The abutment and the pressure-applying bars 56 are then lowered so that the two stacks into which the stack has been divided are forced onto the rows of needles 39 and 40, respectively. The pressure-applying bars 56 are then lifted, in the directions indicated by the arrows in FIG. 9, so that the two stacks 60' and 60'' can be removed.

Figure 10:
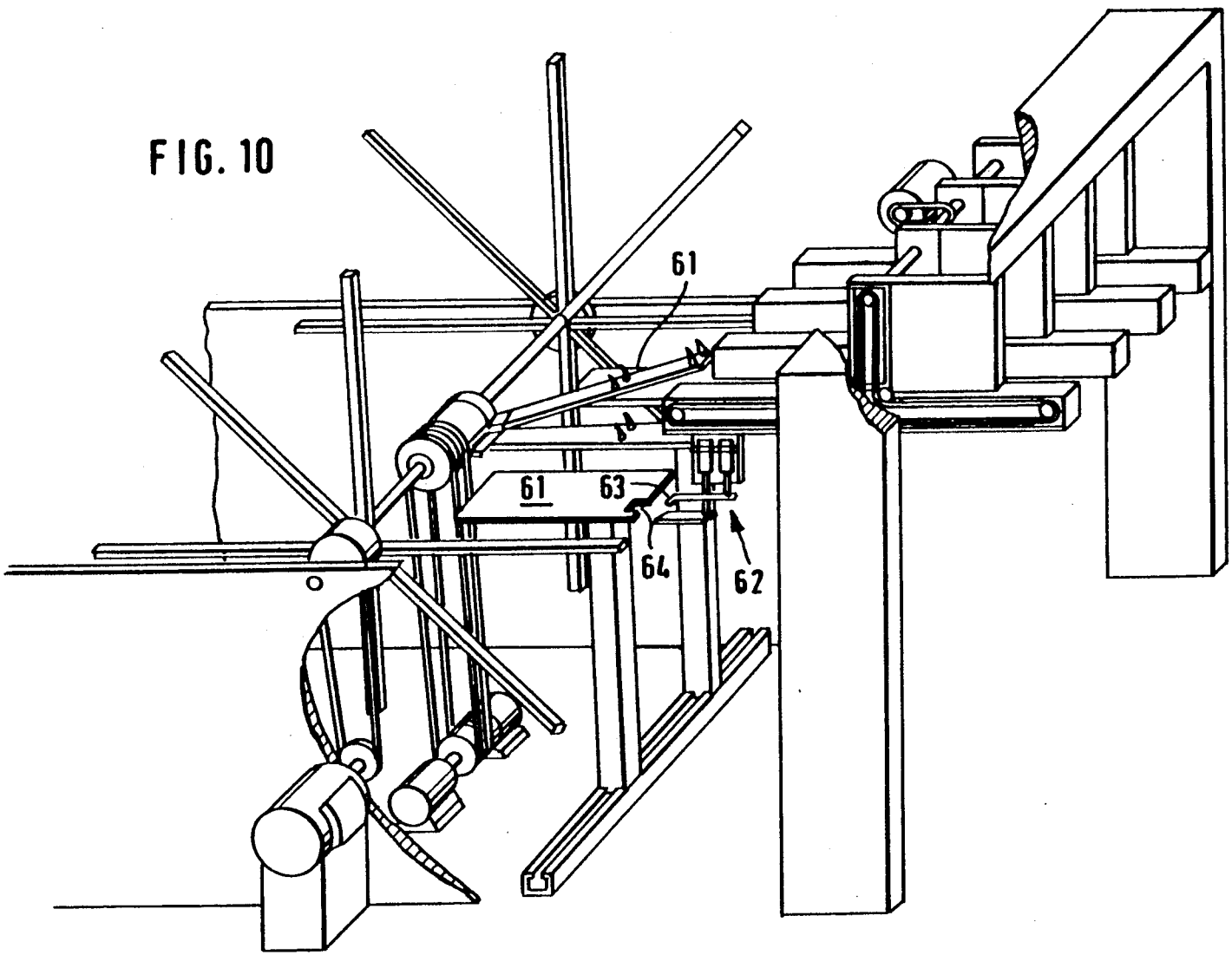
FIG. 10 is a perspective view showing a different feeding arrangement.

The embodiment shown in FIG. 10 differs from that shown in FIG. 1 in that a stack can be deposited on a table and can be pulled from that table and carried off, e.g., by the gripper truck 62, which is only diagrammatically indicated. To permit the stack to be gripped by the grippers 63 of that gripper truck 62, the table 61 consists of two halves and is formed with suitable apertures 64. The design of the gripping means need not be described in detail because it does not form the subject matter of the invention.

Figure 11:
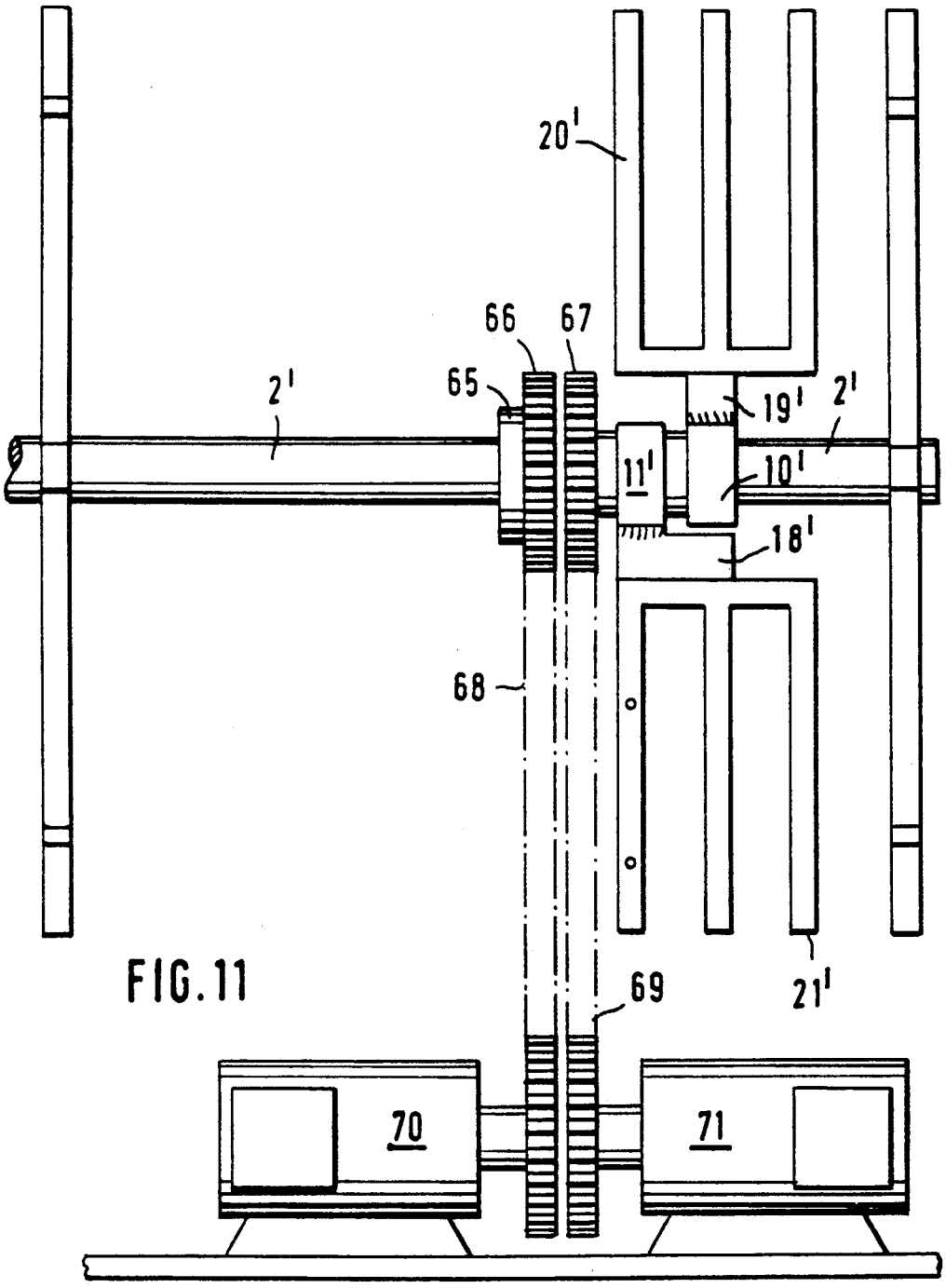
FIG. 11 shows a modification of the wicketer illustrated in FIG. 1.

The stacking apparatuses shown in FIGS. 1 and 2 are designed for two-up processing. The embodiment shown in FIG. 11 is designed for one-up processing. In this case, the free end portions 20' and 21' consist of rakes. In this embodiment the angled arm 20' is fixedly welded to a sleeve 10', which is mounted on a tube 65, which is rotatably mounted on the shaft 2'. A sleeve 11' is freely rotatably mounted on the tube 65 and the angled lever 18' is fixedly welded to the sleeve 11'. Drive disks 66 and 67 are fixedly connected to the sleeve 11' and to the tube 65, respectively, and are operable to rotate the free end portions 20' and 21'. This is effected by means of mutually independently operable motors 70 and 71 via vee belts 68 and 69.

Figure 12:
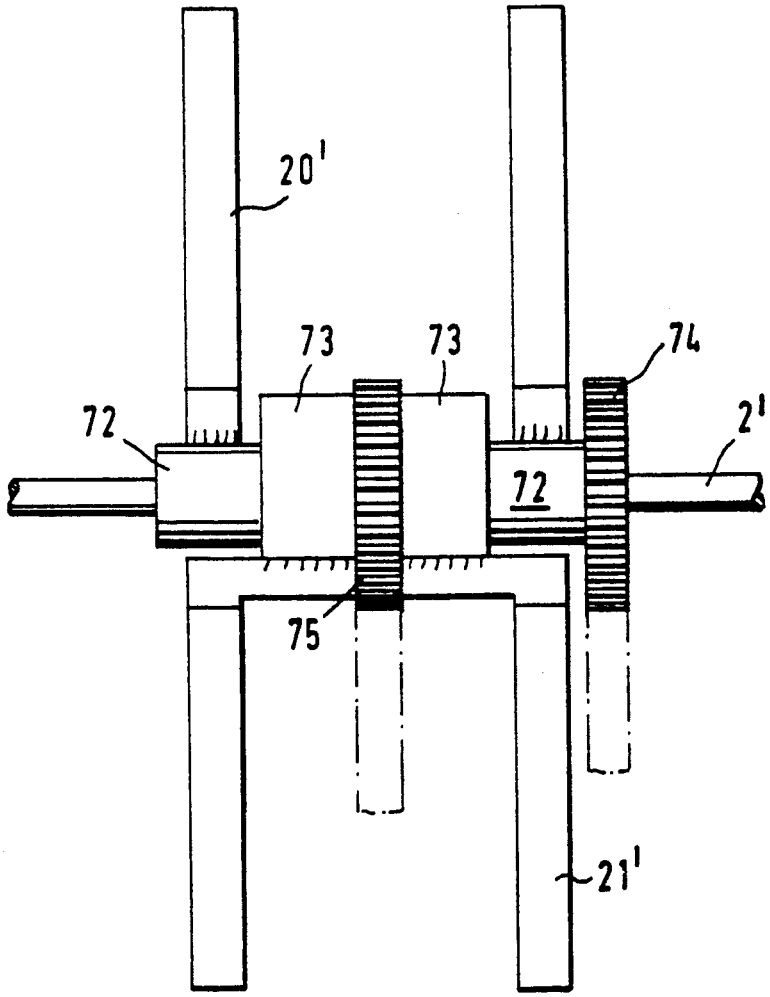
FIG. 12 illustrates a different movable mounting of the arms for an intermediate accumulation on the wicketer.

A different mounting of arms 20'and 21' on the shaft 2' is shown in FIG. 12. It is apparent there that the arms 20' are welded to a hub 72, which is freely rotatably mounted on the shaft 2'. Another hub 73 is freely rotatably mounted on the hub 72 and is fixedly welded to the arms 21'. The arms 20' and 21' can then be rotated by a gear 74, which is fixed to the end of the hub 72, and by a gear 75, which is fixed to the hub 73 near the center of its length.

I claim:

1. An apparatus for stacking flat articles, which have been severed by hot-wire welding from a continuous tubular or semitubular plastic film and which have opening-defining edges adjacent to their center lines, comprising:

a wicketer forming a transfer apparatus having feeding arms, arranged in pairs and in a starlike array, secured to a shaft and rotating about a horizontal axis, at least two radially disposed holding plates on which said bags are needled adjacent to their respective longitudinal center lines, said holding plates being provided in a stacking station and carrying upstanding stacking needles in order to form stacks of said flat articles, the at least two radially disposed holding plates being rotatably mounted on the shaft, separate respective drives connected to each of the radially disposed holding plates, said separate respective drives pivotally moving and consecutively rotating said radially disposed holding plates to a stacking position for receiving the articles, means for removing the stacks from the radially disposed holding plates, and means for moving the stacks away from the radially disposed holding plates.

2. An apparatus according to claim 1, characterized in that each of the radially disposed holding plates is pivotally movable, from a standby position below another of the radially disposed holding plates which is then in its stacking position, to the stacking position, at the same angular velocity as the feeding arms.

3. An apparatus according to claim 1, wherein the means for removing the stacks from the radially disposed holding plates comprises a transfer conveyor for receiving the stacks from the holding plates and for carrying off the stacks, said transfer conveyor including grippers for gripping the stacks, and wherein the means for moving the stacks away from the radially disposed holding plates comprises a stack conveyor including intermittently driven tensile elements and reversing rollers around which said intermittently driven tensile elements are trained.

4. An apparatus according to claim 3, wherein the tensile elements of the stack conveyor are provided with upstanding needles.

5. An apparatus according to claim 3, and further comprising a table which is adapted to be lifted and lowered, wherein the transfer conveyor extends in track channels of the table.

6. An apparatus according to claim 3, wherein the transfer conveyor comprises retaining jaws mounted on chains which are driven to reciprocate, and wherein the grippers cooperate with said retaining jaws and are movably mounted on said chains.

7. An apparatus according to claim 3, and further comprising a stationary cutter blade for severing the stacks provided above at least one of the transfer conveyor and the stack conveyor, and an abutment for urging the stacks against said cutter blade, said abutment being adapted to be lifted and lowered.

8. An apparatus according to claim 7, and further comprising pressure-applying bars, adapted to be lifted and lowered and cooperate with the abutment, provided on both sides of the cutter blade.

9. An apparatus according to claim 1, and further comprising two forked holding plates for stacking single bags, which are to be needled adjacent to their opening-defining edges, the two forked holding plates being movably mounted on the shaft of the wicketer and pivotally movable in the same radial planes.

* * * * *